US007489795B2

(12) United States Patent
Ito

(10) Patent No.: US 7,489,795 B2
(45) Date of Patent: Feb. 10, 2009

(54) HEADPHONE APPARATUS

(75) Inventor: Tomohiro Ito, Kanagawa (JP)

(73) Assignee: Sony Corporation (JP)

( * ) Notice: Subject to any disclaimer, the term of this patent is extended or adjusted under 35 U.S.C. 154(b) by 62 days.

(21) Appl. No.: 11/540,829

(22) Filed: Sep. 29, 2006

(65) Prior Publication Data

US 2007/0025578 A1 Feb. 1, 2007

Related U.S. Application Data

(63) Continuation of application No. 10/399,190, filed as application No. PCT/JP02/08752 on Aug. 29, 2002, now abandoned.

(30) Foreign Application Priority Data

Aug. 31, 2001 (JP) ..... P2001-264601

(51) Int. Cl.
*H04R 25/00* (2006.01)

(52) U.S. Cl. ..... 381/381; 381/374

(58) Field of Classification Search ..... 381/370, 381/371, 374, 376, 381, 330, 71.6, 72, 379, 381/378, 383; 181/128, 129; 379/430
See application file for complete search history.

(56) References Cited

U.S. PATENT DOCUMENTS 6,728,388 B1 4/2004 Nageno et al.
2002/0102005 A1 8/2002 Lin

*Primary Examiner*—Huyen D Le
(74) *Attorney, Agent, or Firm*—Lerner, David, Littenberg, Krumholz & Mentlik, LLP

(57) ABSTRACT

In order to construct a headphone composed of a housing which holds a driver unit and an arm attached to the housing easily and favorably, a driver unit driven by an inputted audio signal, a housing 110 that therein accommodates the driver unit and has on its periphery a first flange portion for attaching an ear pad on the outside and an arm connected to the housing are provided. Then, a second flange portion that is connected to the first flange portion on the housing side is provided so that both the flange portion on the housing side and the flange portion on the arm side function as a flange for attaching an ear pad and also both the flange portions hold the driver unit when the arm is joined to the housing.

19 Claims, 13 Drawing Sheets

PRIOR ART PRIOR ART PRIOR ART

HEADPHONE APPARATUS

CROSS-REFERENCED TO RELATED APPLICATIONS

This application is a continuation of U.S. application Ser. No. 10/399,190 filed on Jul. 17, 2003, the disclosure of which is incorporated herein by reference, and which is a 371 of PCT/JP02/08752 filed on Aug. 29, 2002.

TECHNICAL FIELD

The present invention relates to a headphone worn by hanging an arm extending from the main body of the headphone on an upper part of an auricle.

BACKGROUND ART

A headphone shaped, for example, as shown in FIG. 1 is conventionally in practical use. FIG. 1 is a side view of a headphone in which an arm 2 extends upward from a left housing 1 and is connected to a right housing on the opposite side not shown in the figure. A driver unit driven by an audio signal provided via a cable 4 is accommodated within the housing 1, and an ear pad 3 is provided on the outside of the housing 1.

When a headphone having the shape shown in the FIG. 1 is constructed, the housing 1 and an attachment portion of the arm 2 are integrally formed with resin, whereby the headphone including a comparatively small number of components with simple configuration is constructed.

If the housing 1 and the attachment portion of the arm 2 are integrally formed with resin, it is, however, necessary to cut part of the housing 1 away at the point where the attachment portion of the arm 2 and the housing 1 overlap when the housing 1 is formed with resin, and a concave portion 3*a* that corresponds to the cutaway portion of the housing 1 comes into existence when the ear pad 3 made of a relatively soft sponge-like resin or the like is attached.

The reason why this concave portion is caused will be explained. When the housing 1 and the attachment portion of the arm 2 are integrally formed with resin, a periphery of the integrally formed housing 1 is formed as, for example, shown in FIG. 19. FIG. 2A, FIG. 2B and FIG. 2C show a rear surface, side surface and front surface of the periphery of the integrally formed housing 1 respectively, and the driver unit not shown in the figure is disposed on the rear surface of that shown in FIG. 2A, and the front surface shown in FIG. 2C is exposed to the outside in the assembled state with the ear pad 3 attached.

As shown in FIGS. 2A and 2C, a flange 1*a* is formed on the housing 1 in approximately circular shape to attach the ear pad 3 and by covering the flange 1*a* with the ear pad 3, the ear pad is attached. However, in order that the housing 1 and the attachment portion of the arm 2 are integrally formed, it is impossible to provide the flange 1*a* at the point where the housing 1 overlaps with the attachment portion of the arm 2.

Specifically, as shown in FIG. 2B in this example, a molding die is formed with resin on the core side and on the cavity side separately based on a parting line P, and since it is intended that the attachment portion of the arm 2 is formed, it becomes impossible to form the flange 1*a* at the part where the attachment portion of the arm 2 is formed (namely at an undercut area). Therefore, there is no support member which supports the ear pad 3 at the position where the arm 2 is overlapped with the attachment portion, and a concave portion 3*a* shown in FIG. 18 comes into existence.

As the molding die, the simplest mold of two-plate structure is employed in this example, and although it is possible to form a flange at the undercut portion using a more complicated mold such as a mold of slide core, there may occur problems that production cost rises and then the price of the headphones rises if this kind of complicated mold is used to form the headphone.

Although depending on the shape of the ear pad 3 it is possible to make the concave portion 3*a* inconspicuous, also in this case, the corresponding part of the ear pad 3 is easily dented once it has been pressed, owing to lack of a flange. Also, the ear pad 3 is partly dented once it has been worn by a listener, owing to lack of a flange at the corresponding part, so that the listener feels discomfort at wearing it on his/her auricle. In addition, the occurrence of such concave portion 3*a* causes the ear pad 3 to detach from the housing 1 easily. Making matters worse, there has been a problem in which, once the ear pad 3 has changed and deteriorated over time, the earpad 3 tends to tear easily from the concave portion.

Also, as another problem, it is necessary to pass a cable for supplying an audio signal or the like from the outside to the driver unit accommodated in the housing of this kind of headphone. Note that it has been necessary to provide a mechanism that helps the cable lock midway along the housing so that, when the cable attached to the headphone is being pulled from the outside with some force, the cable will not detach from the driver unit by the force directly affecting the portion where the driver unit and the cable are connected.

Specifically, as shown, for example, in FIG. 3 there is provided the housing 8 in which a driver unit that outputs an audio signal is accommodated within the inside 8*a* thereof. Then, a through-hole 8*b* is provided on the side surface of the housing 8 formed with resin, and a cord 9 is then passed through the through-hole 8*b*. One end of the cord 9 passed through this through-hole 8*b* is soldered and connected to the driver unit within the housing 8. Further, in this example, a knot 9*a* made by tying the cord 9 once is formed within the housing 8 so that the portion where the cord 9 and the driver have been soldered together does not separate if the cord 9 is pulled from the outside, in which the knot 9*a* serves as a stopper as being stopped by the through-hole 8*b* and prevents the soldered portion and the like from being affected by a force when the cord 9 is being pulled from the outside.

Although this construction can prevent the cord from being disconnected, it is necessary to pass the cord 9 through the through-hole 8*b* of the housing 8 and to form the knot 9*a* on the cord itself when the headphone is being assembled so that there has been a problem in which the assembly process is extremely time-consuming.

DISCLOSURE OF INVENTION

An object of the present invention is to simply and favorably construct a headphone comprising a housing which holds a driver unit and an arm attached to the housing.

The present invention is a headphone including a driver unit driven by an audio signal, a housing which accommodates therein the driver unit and has a first flange portion on its periphery in order to attach an ear pad on the outside, and an arm connected to the housing and hung on an upper rear part of the auricle, wherein a second flange portion connected to the first flange portion on the housing side is provided with an arm when connected to the housing.

According to the present invention, since a flange portion that is connected to the flange portion on the housing side is provided on the arm side that is connected to the housing, a flange portion is also arranged at a position what is called an undercut area during the formation of the housing with resin, whereby a flange portion for attaching an ear pad is formed in approximately a circular shape and the ear pad can be held favorably.

BRIEF DESCRIPTION OF THE DRAWINGS

FIGS. 2A to 2C are plan views showing a housing of the headphone shown in FIG. 1, in which FIG. 2A, FIG. 2B and FIG. 2C are views showing a rear surface, a flat surface and a front surface, respectively.

BEST MODE FOR CARRYING OUT THE INVENTION

Hereinafter an embodiment of a headphone according to the present invention will be described with reference to FIGS. 4 to 16.

Figure 1:
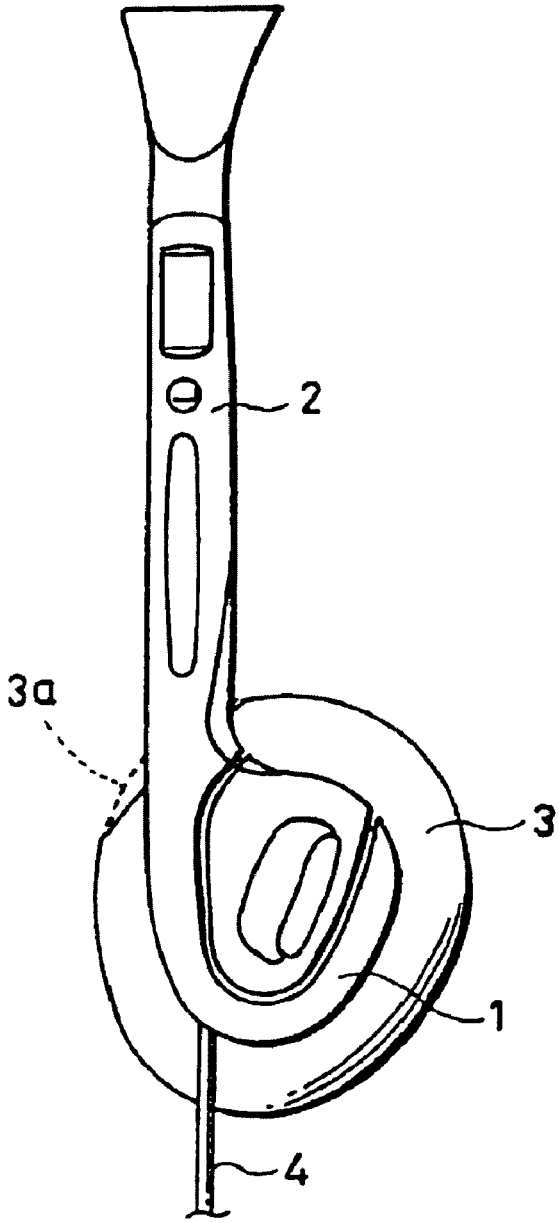
FIG. 1 PRIOR ART
FIG. 1 is a side view showing an example of a conventional headphone.
Figures 2A, 2B, 2C:
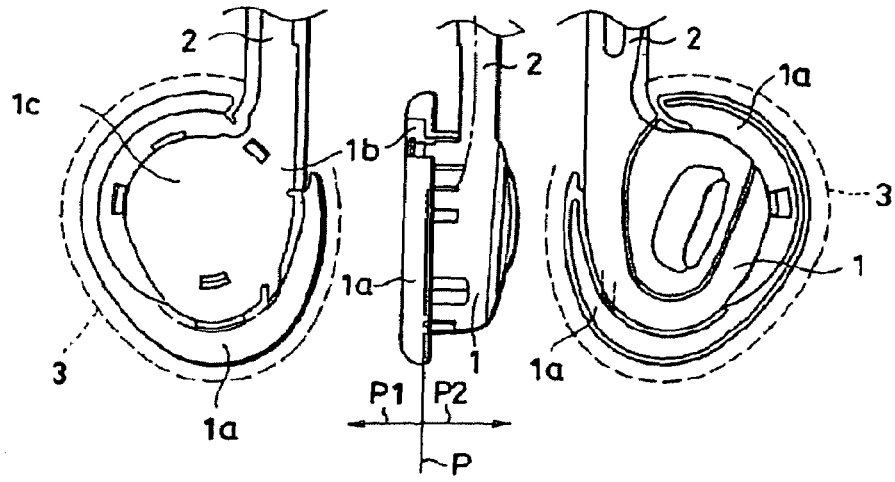
Figure 3:
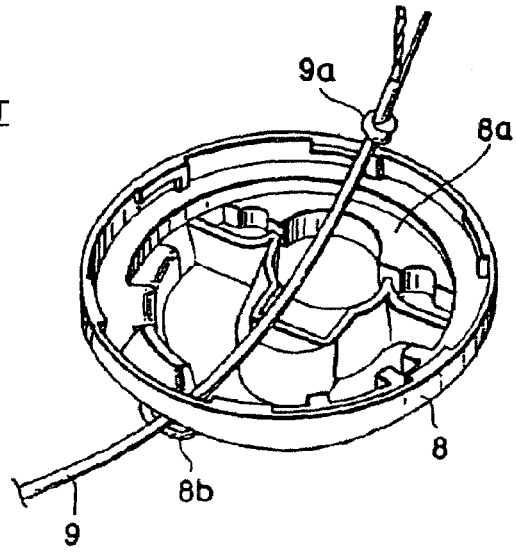
FIG. 3 PRIOR ART
FIG. 3 is a perspective view showing another example of a housing of a conventional headphone.
Figure 4:
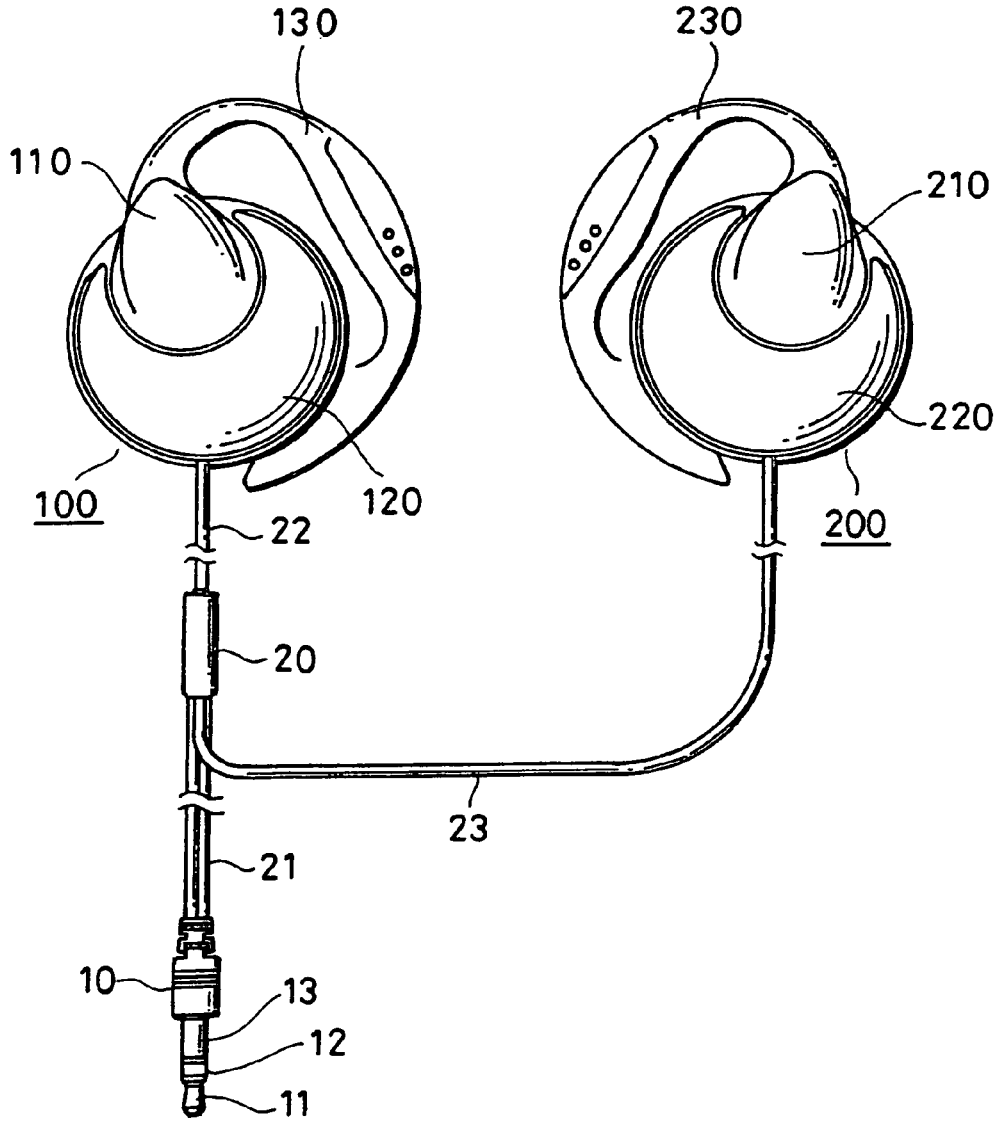
FIG. 4 is a plan view showing an example of the overall construction of a pair of headphones according to an embodiment of the present invention.

In this embodiment, there is provided a pair of headphones without a hair band, in which units constituting the headphones are worn by hanging hanger-shaped arms on a listener's auricles. In more detail, as shown in FIG. 4, the overall construction of the headphones in this embodiment has a left side unit 100 which is worn on the auricle of left ear and a right side unit 200 which is worn on the auricle of right ear.

Also, in this embodiment a plug 10 which is inserted into a headphone jack of an audio signal sauce such as an audio reproducing apparatus or a radio receiver set is connected to a cord-connecting portion 20 via a cord 21, a cord 22 connects this cord-connecting portion 20 and the left side unit 100, and a cord 23 connects the cord-connecting portion 20 and the right side unit 200. The cords 22 and 23 are connected to driver units inside the left side unit 100 and the right side unit 200, respectively. As a plug 10, for example, the plug comprising three electrode portions 11, 12 and 13 is used.

The left side unit 100 and the right side unit 200 include approximately circular housings 110 and 210, respectively, both of which are formed of a relatively hard resin such as ABS resin and accommodate driver units that output audio signals, and caps 120 and 220 are attached to the outside of the housings 110 and 210. Ear pads are attached to the parts where the housings 110 and 210 are brought in contact with the ears.

Arms 130 and 230 which function as hangers when worn on the auricles are attached to upper parts of the left and right housings 110 and 210. These arms 130 and 230 are formed of a relatively flexible resin such as PP (polypropylene), PBT (polybutyleneterephthalate), or POM (polyacetal). In this embodiment, the housings 110 and 210 on the left side and right side are exactly the same in shape, whereas the arms 130 and 230 are symmetrical.

Figure 5:
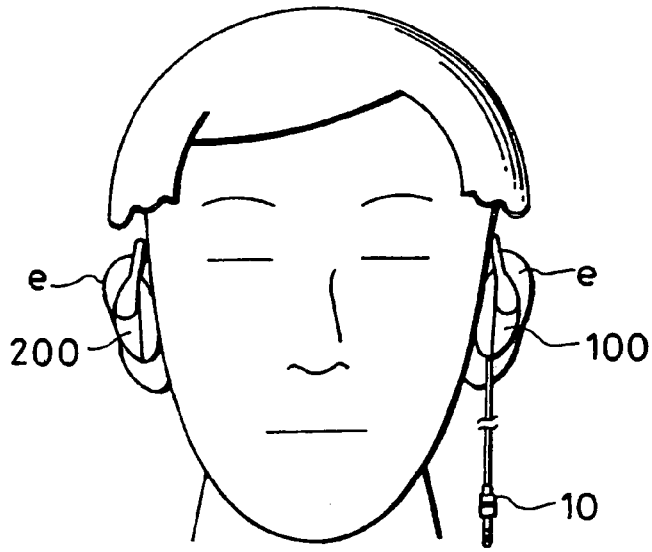
FIG. 5 is a front view showing an example of how a pair of headphones according to an embodiment of the present invention is worn.
Figure 6:
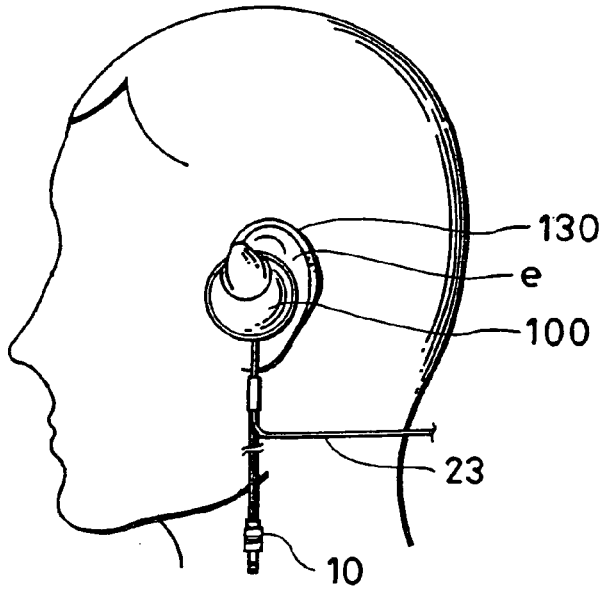
FIG. 6 is a side view showing an example of how a pair of headphones according to an embodiment of the present invention is worn.

An example of how the headphones according to the embodiment are worn is shown in FIGS. 5 and 6, in which the left and right side units 100 and 200 are worn by passing the arms 130 and 230 behind upper parts of a listener's left and right auricles e. The cords 22 and 23 connecting the left and right side units 100 and 200 are passed in the back of the head, for example.

Figure 7:
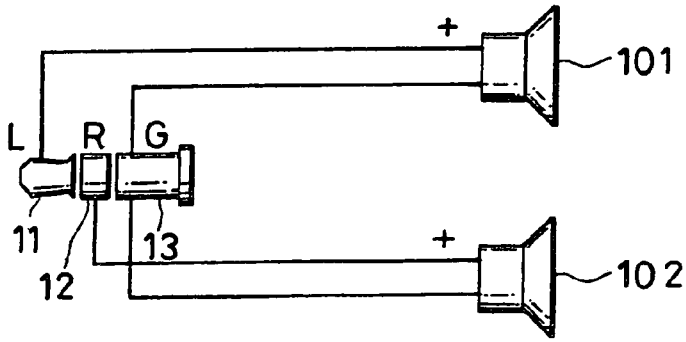
FIG. 7 is a circuit diagram showing an example of connection of a pair of headphones according to an embodiment of the present invention.

Assuming that a driver unit 101 is accommodated within the left side unit 100 and a driver unit 102 is accommodated within the right side unit 200, with reference to FIG. 7 showing an example of how each of the electrodes 11, 12 and 13 of the plug 10 and a driver unit in each unit are connected, the electrode 11 on the tip of the plug 10 is connected to one pole of the driver unit 101 within the left side unit 100, the electrode 12 in the middle of the plug 10 is connected to one pole of the driver unit 102 within the right side unit 200, and the electrode 13 on the rear end of the plug 10 is connected to the other poles of the driver units 101 and 102 within the units 100 and 200, respectively.

Figure 8:
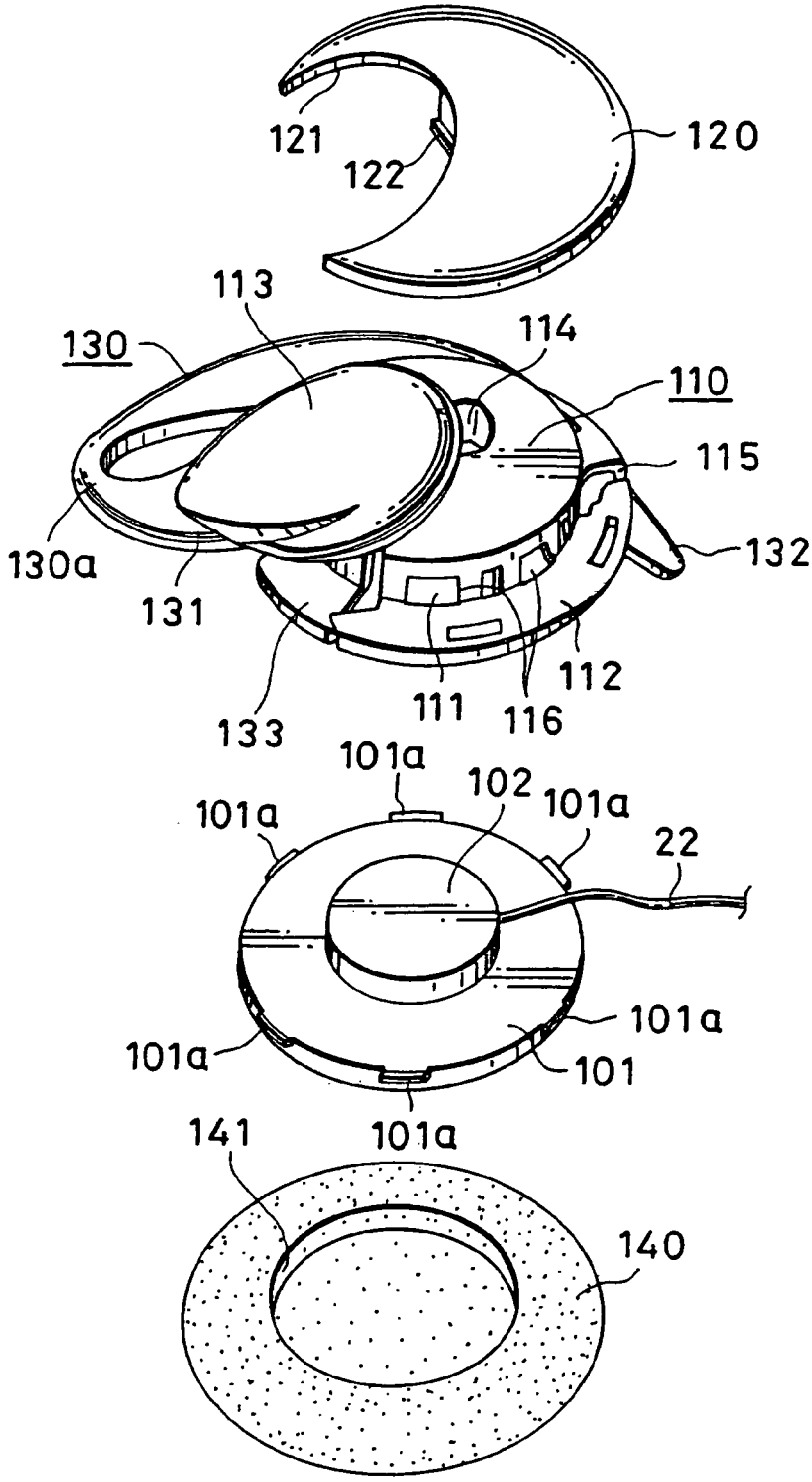
FIG. 8 is an exploded perspective view showing an example of construction of a headphone according to an embodiment of the present invention.
Figure 9:
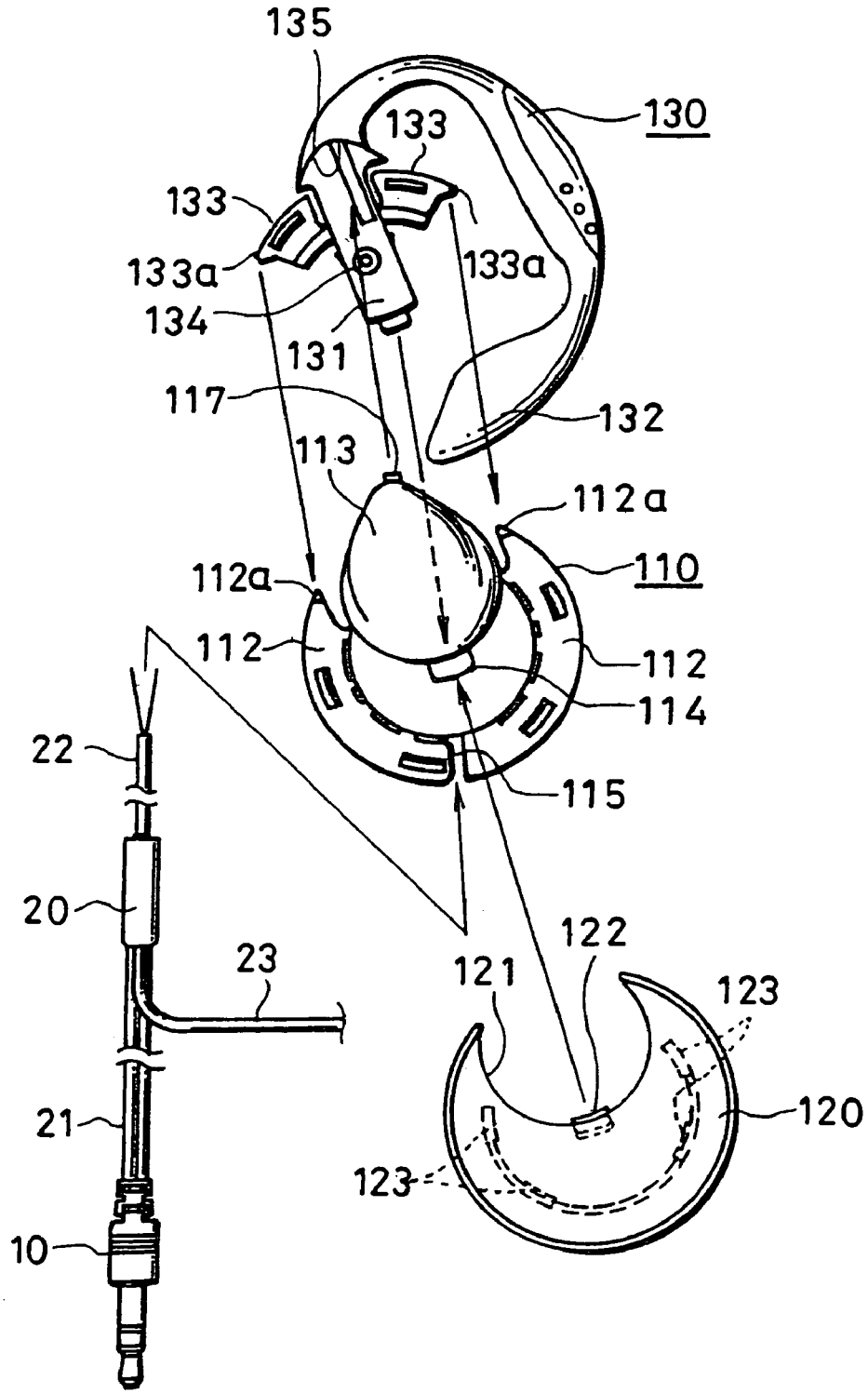
FIG. 9 is a plan view showing an example of a housing and arm according to an embodiment of the present invention in an exploded form.

The above headphones having such construction according to this embodiment are characterized by the shapes of the housings 110 and 210, and the arms 130 and 230. Hereinafter the construction will be described. FIGS. 8 and 9 are views showing the left side unit 100 in an exploded manner. Although only the left side unit 100 is described in the followings and the construction of the right side unit 200 is not particularly described, it is noted that the construction of the right side unit 200 is exactly the same as that of the left side unit 100 except that the arm 230 and the left arm 130 are symmetrical in shape. Further it is noted that in the following description, a surface facing outward when the unit is being worn is referred to as a front surface, a surface facing inward when the unit is being worn is referred to as rear surface, and sounds from the driver unit are outputted from the rear surface side.

FIG. 8 shows a state in which the housing 110 and the arm 130 are combined into a single unit, and FIG. 9 shows a state in which the housing 110 and the arm 130 separated. The arm 130 comprises a housing-connecting portion 131 connected to a peaked portion 113 of the housing 110 such that the housing-connecting portion 131 is inserted into the inside of the peaked portion 113, an auricle passage bend 130*a* bent in U shape extending from the connecting portion 131, and an end 132 which extends further from the bend 130*a*.

The housing 110 to which the above-mentioned arm 130 is connected is approximately circular in shape, a driver-accommodating portion 111 is constructed at the center of the inside thereof, and the circular driver unit 101 is attached to this driver-accommodating portion 111. A rib 101*a* to attach the housing is provided in six positions at regular intervals of 60° on the side surface of this circular driver unit 101. The cord 22 connected to the driver unit 101 to provide an audio signal is passed through a cutaway portion 115, which is provided at a midway position of a flange portion 112 provided on the housing 110, that is in this embodiment almost opposite to the position where the peaked portion 113 has been formed, Also, a first flange portion 112 is formed around the housing 110. Although a flange portion is not provided at the part to which the arm 130 is connected, that is, at the position inside the housing side where the peaked portion 113 has been formed, a second flange portion 133 is provided on the arm 130 side in this embodiment, so that when the housing 110 and the arm 130 are joined, the flange portion 112 on the housing side and the flange portion 133 on the arm side are connected as a single unit to form an approximately circular flange.

A circular ear pad 140 is attached to these flange portions 112 and 133. The ear pad 140 formed, for a example, of a sponge-like resin has a circular hole 141 as shown in FIG. 8 and is attached by fitting the hole 141 to the flange portions 112 and 133.

A circular cap 120 is attached to the outside of the housing 110. The cap 120 has a circular cutaway portion 121 corresponding to the peaked portion 113 on the housing side, and an engaging projection 122 is provided at approximately the center of the hem of the cutaway portion 121. In order to attach this cap 120, a cap-attaching hole 114 is provided on the outside of and at the center of the housing 110, and the cap 120 is attached to the housing 110 by inserting the engaging projection 122 of the cap 120 side into the hole 114 of the housing 110.

Also, as shown by the broken lines in FIG. 9, projections 123 are formed at a plurality of positions inside the cap 120 so that the position of the cap 120 is fixed by fitting these projections 123 into openings 116 provided on the side wall of the driver-accommodating portion 111 on the housing 110 side. Further, the end of the ear pad 140 (the opening 141) is concealed with the cap 120, when the cap 120 has been attached with the ear pad 140 being fitted.

Figure 10:
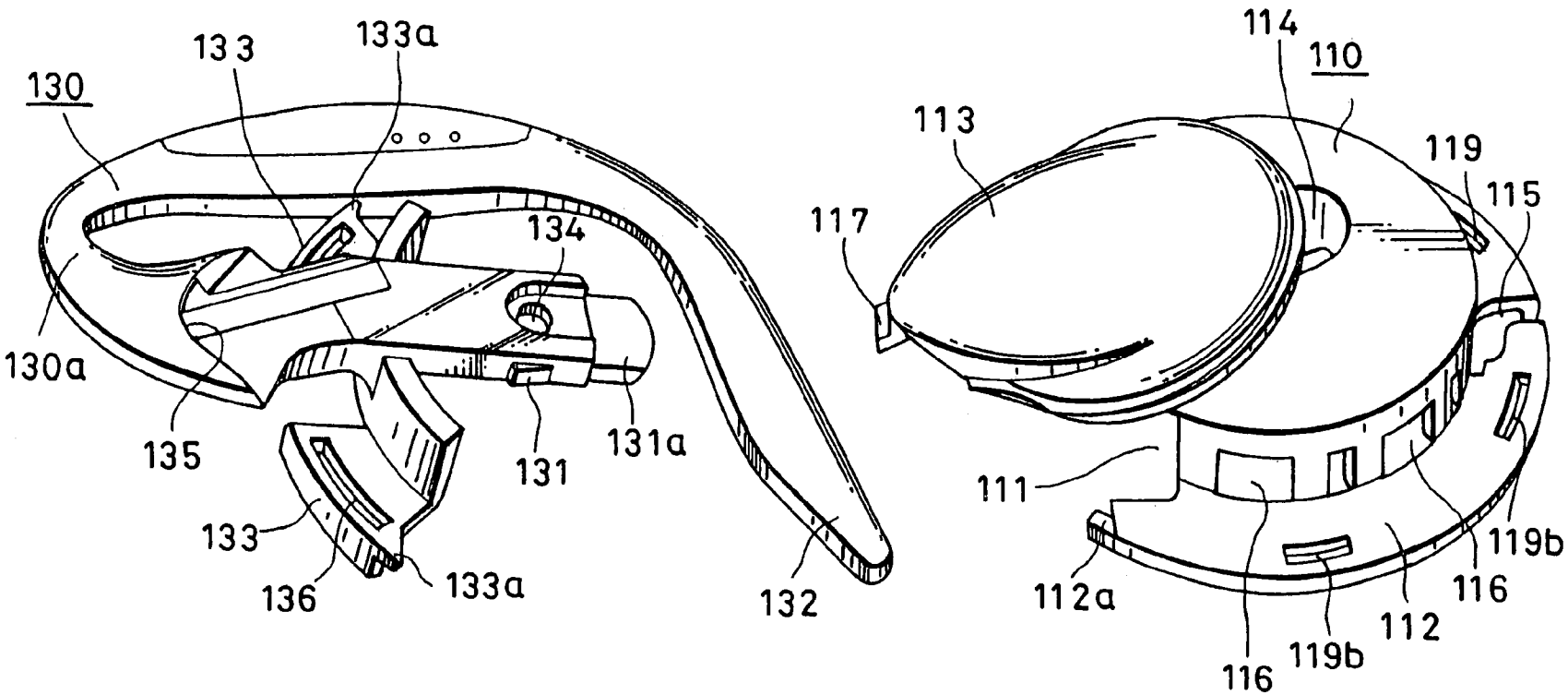
FIG. 10 is a perspective view showing an example of a housing and arm according to an embodiment of the present invention in an exploded form.
Figure 11:
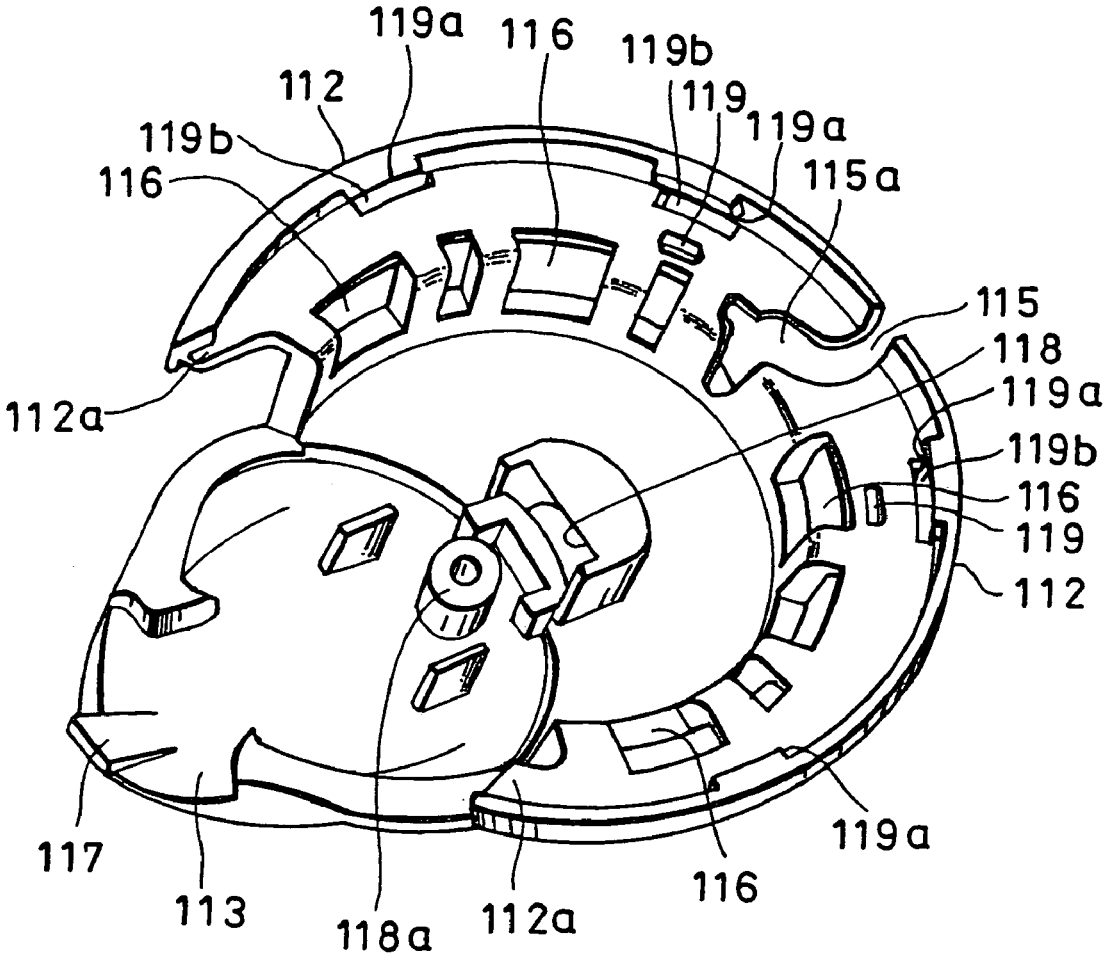
FIG. 11 is a perspective view showing an example of the rear surface side of a housing according to an embodiment of the present invention.
Figure 12:
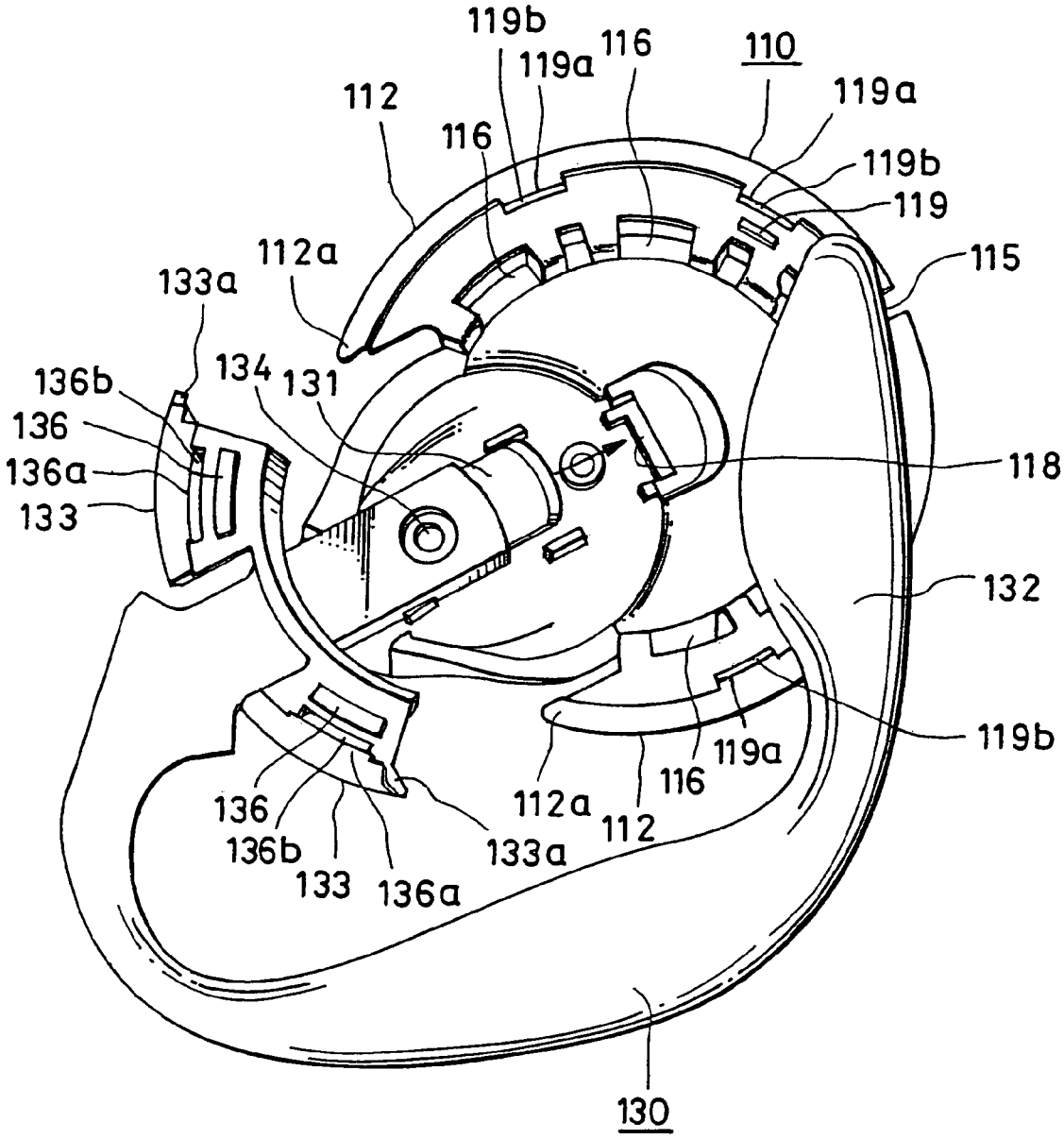
FIG. 12 is a perspective view showing an example of a state in which a housing and arm are being connected to each other according to an embodiment of the present invention.
Figure 13:
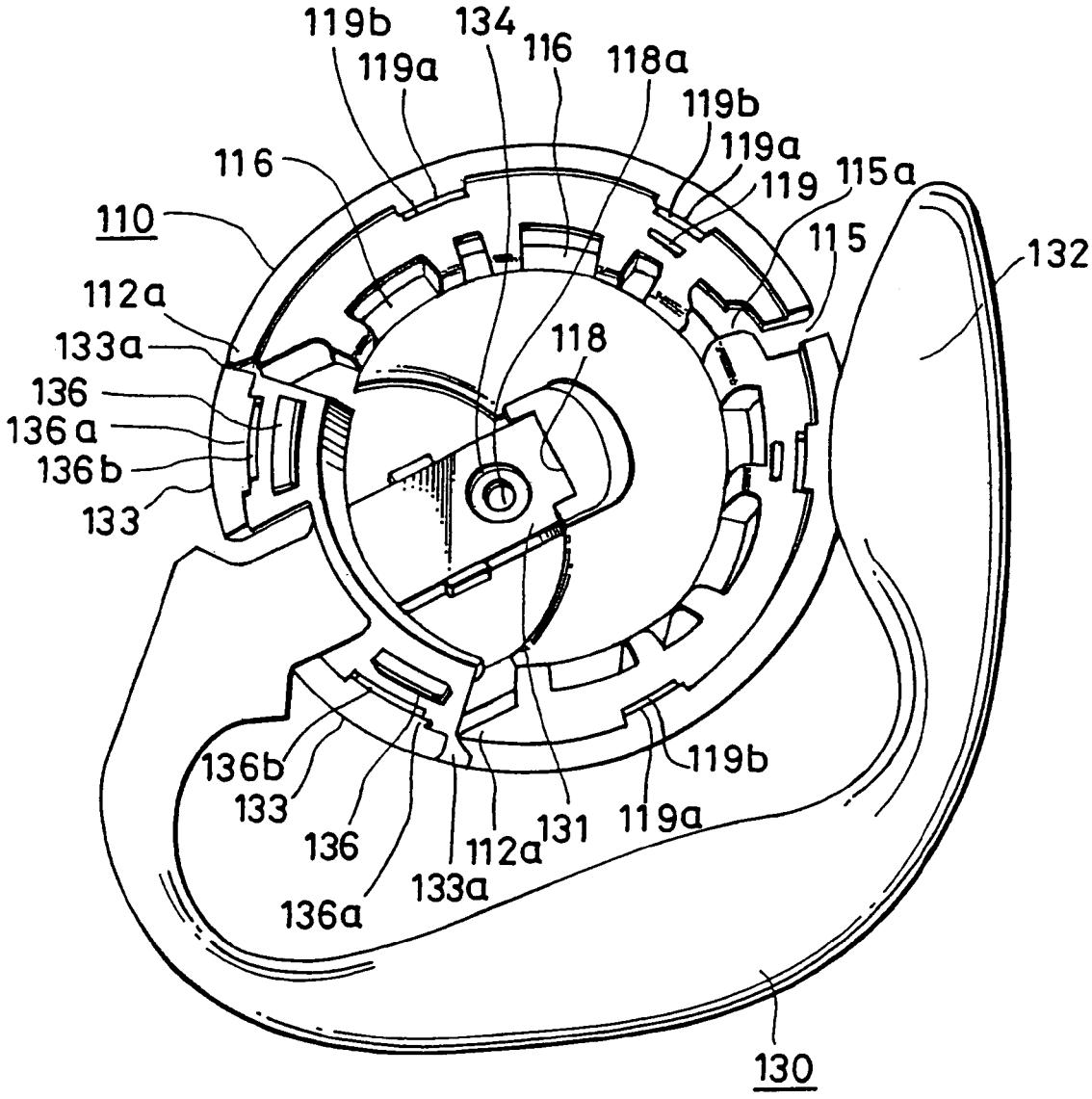
FIG. 13 is a perspective view showing an example of a state in which a housing and arm are connected according to an embodiment of the present invention.
Figure 14:
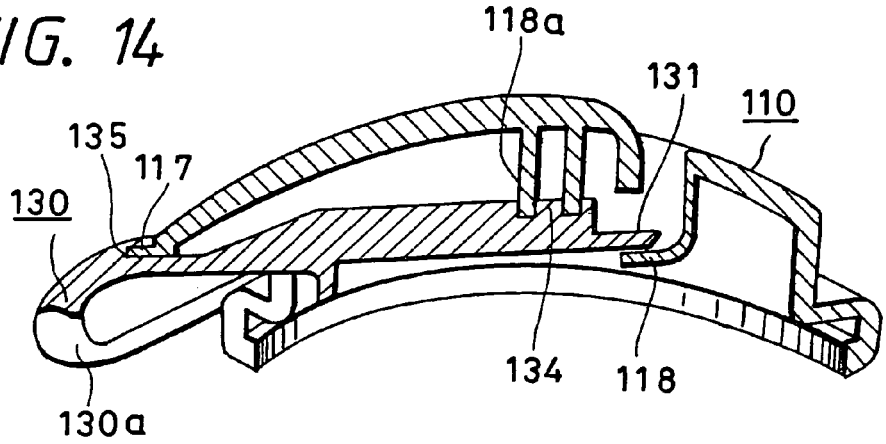
FIG. 14 is a cross-sectional view showing an example of a state in which a housing and arm are connected according to an embodiment of the present invention.

Hereinafter, with reference to FIGS. 10 to 14, the construction of the housing 110 and the arm 130 according to this embodiment will be described in detail. FIG. 10 is a view in which the housing 110 and the arm 130 are shown from the front surface side, FIG. 11 is a view in which the housing 110 is shown from the rear surface side, FIG. 12 is a view shown from the rear surface side, in which the arm 130 is in a state of being adjacent to the housing 110 to connect, and FIG. 13 is a view in which the housing 110 and the arm 130 have been completely connected to each other. FIG. 14 is a cross sectional view showing this state.

As shown in FIGS. 10 and 11, the housing 110 of this embodiment comprises the first flange portion 112 formed around the circular, protruding driver-accommodating portion 111, and the plurality of openings 116 are formed on the side wall of the driver-accommodating portion 111.

Further, the peaked portion 113 is formed at the part connected to the arm 130 on the front surface side. The peaked portion 113 is approximately circular in shape, and only the peaked portion 113 of the housing 110 is exposed to the outside when the headphone has been finally assembled. A projection 117 is provided on the edge of the peaked portion 113, and this projection 117 is accommodated in a housing-connecting groove 135 on the arm side when the arm 130 has been attached.

The first flange portion 112 is formed on the housing 110 except the part under the peaked portion 113. The part under the peaked portion 113 becomes what is called the undercut area when the housing is formed with resin, and when a simple mold of two-plate structure is used, it is impossible to form a flange portion in this undercut area. Concave portions 112*a* to engage with the flange portion on the arm side are provided on either end of the flange portion 112 except for the part under this peaked portion 113.

The cutaway portion 115 for passing the code, which is provided at a midway position of the first flange portion 112, is cut away deep as far as the side wall of the driver-accommodating portion 111 (namely a position adjacent to the openings 116) as shown in figures such as FIG. 11, and a bend portion 115*a* is provided at a midway position of the cutaway portion 115. The cutaway portion 115 becomes narrower past the bend portion 115*a* such that the passing cord 22 is held. When the cord 22 connected to the driver unit 101 passes through the cutaway portion 115, the cord 22 is put deep into this cutaway portion 115.

Further, as shown in FIG. 11, an arm-connecting hole 118 is provided at approximately the center on the rear surface side of the housing 110, and an arm-connecting projection 118*a* is also formed in the vicinity of the hole 118. In addition, the arm-connecting hole 118 is formed as one continuous hole with the cap-attaching hole 114 (shown in figures such as FIG. 10) at the center on the front surface of the housing 110.

Also, as shown in FIG. 11, driver-fixing ribs 119 are provided at a plurality of positions on the rear surface side of the flange portion 112, and driver-fixing grooves 119*a* are provided in the vicinity of the ribs 119 on the periphery of the flange portion 112. In this embodiment, both the ribs 119 and the grooves 119*a* are provided in four places at an interval of 60°. Note that in order to form the grooves 119*a* by a mold of two-plate structure, openings 119*b* are provided at the positions where the grooves 119*a* of the flange portion 112 are formed.

As shown in FIG. 10, the arm 130 includes the second flange portions 133 formed on the left and right of the elongated housing-connecting portion 131, and the second flange portions 133 have the shape as continuing from the flange portion 112 on the housing side. Since the position right under the housing-connecting portion 131 is in the undercut area when the arm is formed, a flange portion is not provided as shown in figures such as FIG. 12. However, the length of the part without a flange portion is not long, because the housing-connecting portion 131 has been made relatively narrow in width.

Convex portions 133*a* are formed on both ends of the second flange portion 133 provided on the arm 130. These convex portions 133*a* have been, as shown in FIG. 10, formed of the protruding ends on the front surface side, and the protruding form is made to engage with the concave portions 112*a* of the ends of the flange portion 112 on the housing side.

An end 131*a* of the elongated connecting portion 131 of the arm 130 has such a form (thickness) as can be inserted into the arm-connecting hole 118 on the housing 110 side, and a housing-connecting hole 134 is formed at the position where the housing-connecting hole 134 is brought in contact with the arm-connecting projection 118*a* provided on the housing 110 side when the connecting portion 131 is inserted into the arm-connecting hole 118. Furthermore, the housing-connecting groove 135 is formed in the vicinity of the portion to which the flange portion 133 of the arm 130 is attached. This groove 135 has such a shape that the projection 117 on the edge of the peaked portion 113 on the housing 110 side can be inserted.

Further, as shown in FIG. 12 showing the rear surface side of the arm 130, driver-fixing ribs 136 and driver-fixing grooves 136*a* adjacent to the ribs 136 on the periphery are provided at each position on the left and right on the rear surface side of each flange portion 133 of the arm 130. These two ribs 136 and so on are arranged at an interval of 60°. In order to form the grooves 136*a*, openings 136*b* are provided at the positions where the grooves 136*a* of the flange portion 133 are formed. The state in which the ribs 136, the grooves 136*a* and the openings 136*b* of this second flange portion 133 are formed is exactly the same as that in which the ribs 136, the grooves 136*a* and the openings 136*b* on the housing 110 side are formed. Accordingly, when the arm 130 and the housing 110 are connected as later described, the driver-fixing ribs (119, 136) and the driver-fixing grooves (119*a*, 136*a*) are, as shown in FIG. 13, arranged in six positions at an interval of 60° on the first and second flange portions 112 and 133 which have been joined into a single unit.

When the arm 130 is joined to the housing 110 constructed in this manner, the end 131*a* of the housing-connecting portion 131 of the arm 130 is, as shown in FIG. 12, inserted into the arm-connecting hole 118 on the rear surface of the housing 110 to be in the state shown in FIG. 13 and then the arm-connecting projection 118*a* of the housing 110 is inserted into the housing-connecting hole 134 in the arm 130. Also, as shown by the cross section in FIG. 14 showing the joined state, the projection 117 on the edge of the peaked portion 113 on the housing 110 side is inserted into the groove 135 of the housing-connecting portion 131 of the arm 130. By fitting and joining the arm 130 and the housing 110 as described above, the joined state is reliably maintained.

When the housing 110 and the arm 130 are joined, the flange portion 112 on the housing 110 side is connected to the flange portion 133 on the arm 130 side, thereby forming approximately the circular flange portion as shown in FIG. 13. The concave portions 112*a* and the convex portions 133*a* having the shapes which engage with each other are respectively formed at the parts where the flange portion 112 on the housing 110 side is brought in contact with the flange portion 133 on the arm 130 side, so that the two flange portions 112 and 133 will be made into a single flange.

Figure 15:
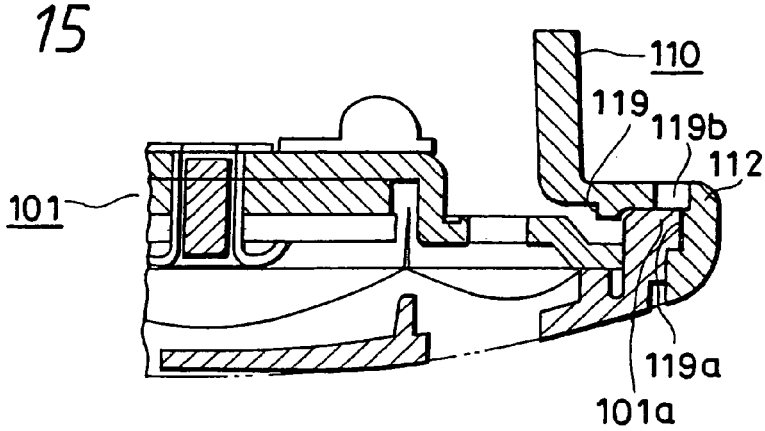
FIG. 15 is a cross-sectional view showing an example of a state in which a driver is attached to the housing according to an embodiment of the present invention.

With the housing 110 and the arm 130 being joined in this manner, as mentioned above with reference to FIG. 8, the driver unit 101 is accommodated in the driver-accommodating portion 111 of the housing 110. Then, the driver-fixing ribs (119 or 136) and the driver-fixing grooves (119*a* or 136*a*) are arranged at regular intervals on the rear surface sides of the flange portions 112 and 113 which have been joined into a single unit, and then the driver unit 101 is fixed to the housing 110 by inserting the ribs 101*a*, which are arranged at regular intervals on the periphery of the driver unit 101, between the ribs and the grooves of these flange portions. FIG. 15 is a crosssectional view showing the state in which the driver unit 101 is fixed to the housing 110.

It is noted that when the driver unit 101 is attached, the cord 22 connected to the driver unit 101 is led to the outside by passing through the cutaway portion 115 of the housing 110.

Figure 16:
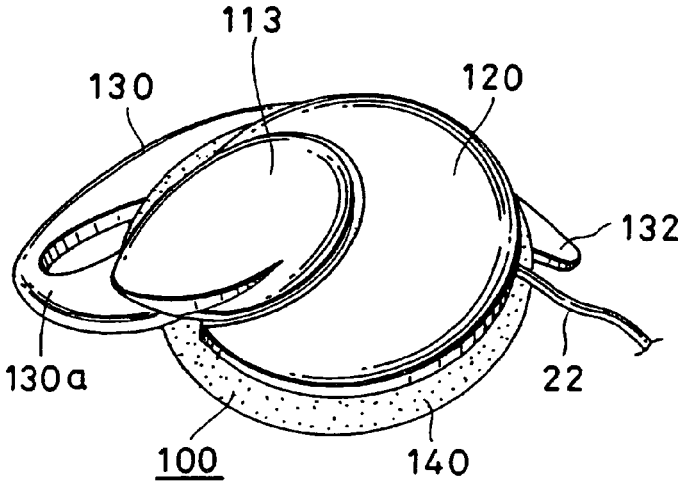
FIG. 16 is a perspective view showing an example of a state in which a left side unit of headphones is assembled according to an embodiment of the present invention.

Then a headphone is assembled by covering the housing 110 to which the driver unit 101 is attached and the flange portions 112 and 133 of the arm 130 with such an ear pad 140 as shown in FIG. 8. Moreover, by utilizing the cap-attaching hole 114 on the outside of the housing 110, the cap 120 shown in FIG. 8 is attached to be assembled as shown in FIG. 16.

According to the above-described headphone of this embodiment having such a construction, the headphone having a favorable shape is simply constructed. Specifically, as shown in FIG. 8, only a driver unit, a housing which accommodates the driver unit, an arm connected to the housing, an ear pad and a cap are required as components which compose the main body of the headphone, and the housing and the arm are simply constructed using a mold of two-plate structure, whereby the headphone can be manufactured inexpensively.

It is noted that when the housing is simply constructed using a mold of two-plate structure, it is impossible to provide a flange to which an ear pad is attached for the part which overlaps with the portion where the housing and the arm are connected (namely the undercut area). However, in this embodiment since the headphone is constructed such that a corresponding flange portion is provided on the arm side as well, there is provided a flange to which an ear pad is attached at the portion where the housing and the arm are connected, so that the ear pad can be hold by the flange portions having approximately complete circular shape. Accordingly, it is possible to prevent deformation of such ear pad shown in FIG. 18 as a prior art, the wearer does not feel discomfort, and it is possible to efficiently prevent damage such as the breaking of the ear pad.

Further, since the concave portions 112*a* and the convex portions 133*a*, which are shaped to be engaged with each other, are formed at the parts where the flange portion 112 on the housing side is brought in contact with the flange portion 133 on the arm side, the two flange portions 112 and 133 are made into an single flange, so that the flange portion 112 on the housing side and the flange portion 133 on the arm side are prevented from being positioned out of place and the united flange operates favorably as a mechanism for attaching an ear pad.

Further, since ribs and grooves as a mechanism for holding the driver unit 101 are provided on both the flange portion 112 on the housing side and the flange portion 133 on the arm side, the driver unit 101 is favorably held.

Figure 20:
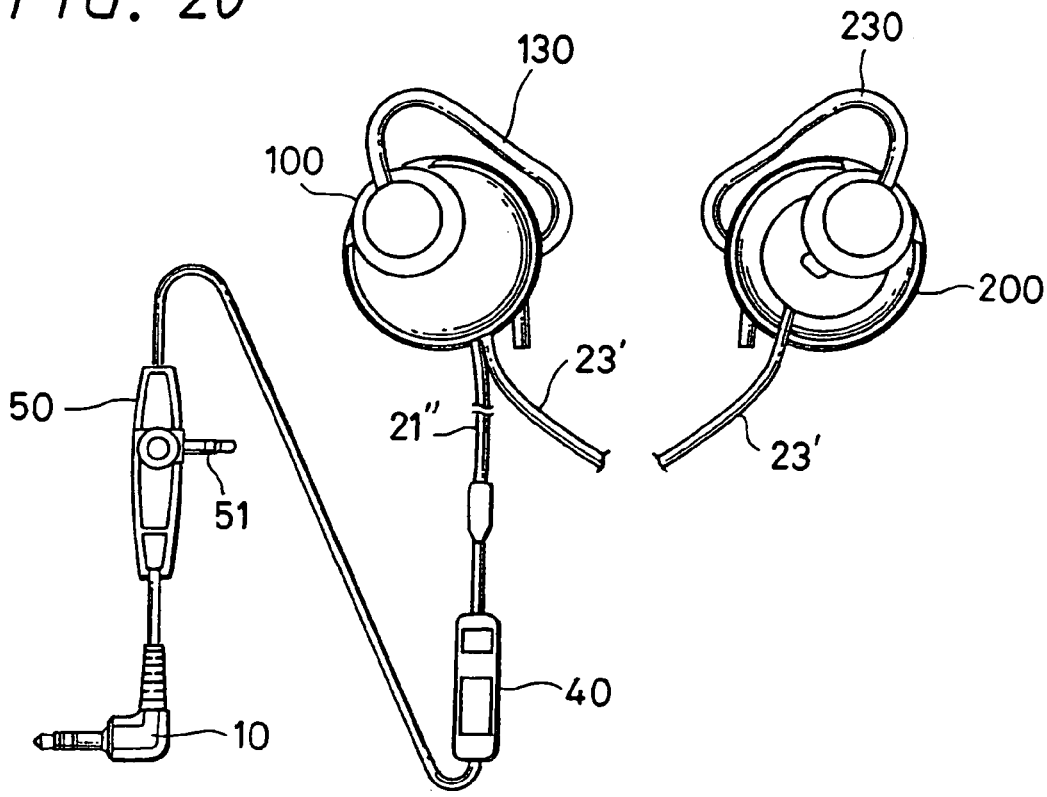
FIG. 20 is a plan view showing another example of a case in which a microphone is attached to a pair of headphones according to an embodiment of the present invention.

Furthermore, in the construction of this embodiment, though the cord 22 connected to the driver unit in the headphone is simply passed through the cutaway portion 115 provided on the housing 110, the cord 22 hardly detaches because the bend portion 115*a* is provided in the middle of the cutaway portion 115 allowing the cord to be sandwiched past the bend portion. Accordingly, even if the cord 22 is pulled by a force from the outside of the headphone, the portion where the cord 22 and the driver unit 101 are connected is not easily affected by the force because the cord 22 is placed inside the housing 110 via the cutaway portion 115, and therefore separation or the like of the portion where the cord 22 and the driver unit 101 are soldered together can be efficiently prevented by the simple construction. Thus, as shown in FIG. 20 as a prior art, there is no need to provide a knot in a middle of the cord, and efficiency during the assembly process improves.

Further, in this embodiment the cap 120 is provided, so that vicinity of the boundary between the housing 110 and the ear pad 140 is concealed by the cap 120, and the appearance of the headphone improves. With respect to the housing 110, in particular, only the peaked portion 113 is exposed to the outside and the flange portion and the rest can not be seen from outside at all, so that if the housing 110 is composed of the material which is different from the material of the arm 130, the difference will not be easily noticed. Also, in case the housing 110 and the arm 130 are composed of the materials on which it is difficult to perform printing or painting, it is only required to form the cap 120, which is easily noticed from outside, of a material on which it is easy to print or paint, so that the merchantability of the headphone is enhanced by printing, painting or the like on the cap. Consequently, design for the headphone can be freely selected with the simple construction.

It is noted that although the above-described headphones are of a type in which each unit is constructed on the left side and right side separately and the respective left and right units are hung on the left and right auricles by their respective arms, this embodiment can be applied to headphones of a type in which left and right units are connected by a single arm (band).

Figure 17:
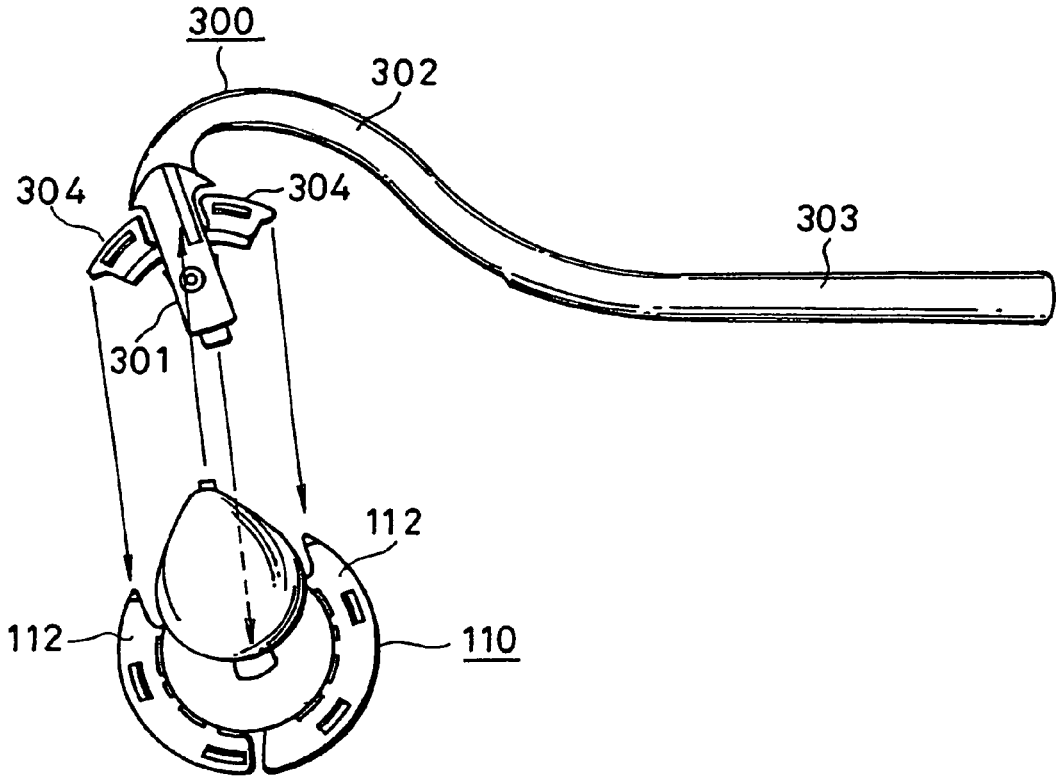
FIG. 17 is a plan view showing an example of a case in which a pair of headphones according to an embodiment of the present invention is applied to neckband-type headphones.

Specifically, as shown in FIG. 17, so-called neckband-type headphones in which a single arm 300 is passed behind the back of the head of a wearer are constructed, for example. The left housing 110 is attached to one end of the arm 300 and the right housing 210 is attached to the other end of the arm 300 not shown in the figure. The construction of the housing-attaching portion of the arm 300 is exactly the same as that in the previous explanation referring to FIGS. 8 to 14, in which a housing-connecting portion 301 is constructed at an end of the arm 300, the part extending from the connecting portion 301 is made as a bend 302 capable of being hung on an upper, rear part of the auricle, and the further back part of the arm is termed a neckband portion 303. Then, second flange portions 304 are provided on the left and right of the housing-connecting portion 301 to be connected to the flange portion on the housing 110 side.

Figure 18:
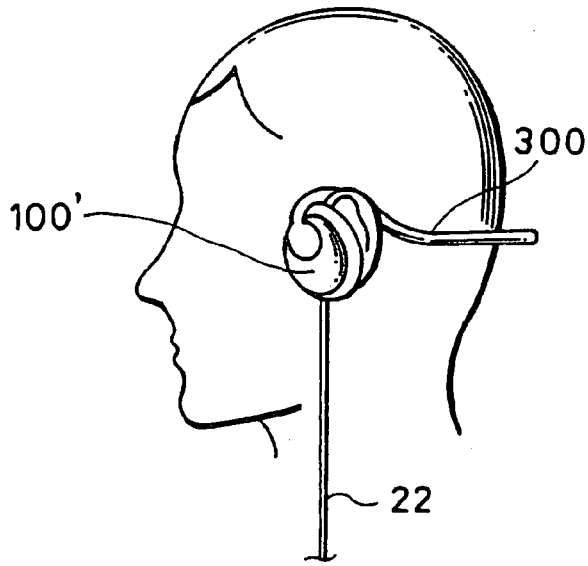
FIG. 18 is a side view showing an example of how the pair of headphones shown in FIG. 17 is worn.

Provided that headphones are constructed as shown in this FIG. 17, the embodiment can be applied to the neckband-type. FIG. 18 shows an example in which headphones constructed as the neckband-type headphones are worn by a listener. The left side unit 100' of the neckband-type headphones is worn such that the unit is hung on the listener's left auricle.

Also, if headphones which include two left and right units are not constructed, but a monaural-type earphone which is worn on either of the left and right ears is constructed, the housing and the arm may be constructed as mentioned above.

Also, though in the above-described embodiments, the constructed headphones have only the function of outputting audio signals, the embodiments can be applied to a headset which includes a microphone.

Figure 19:
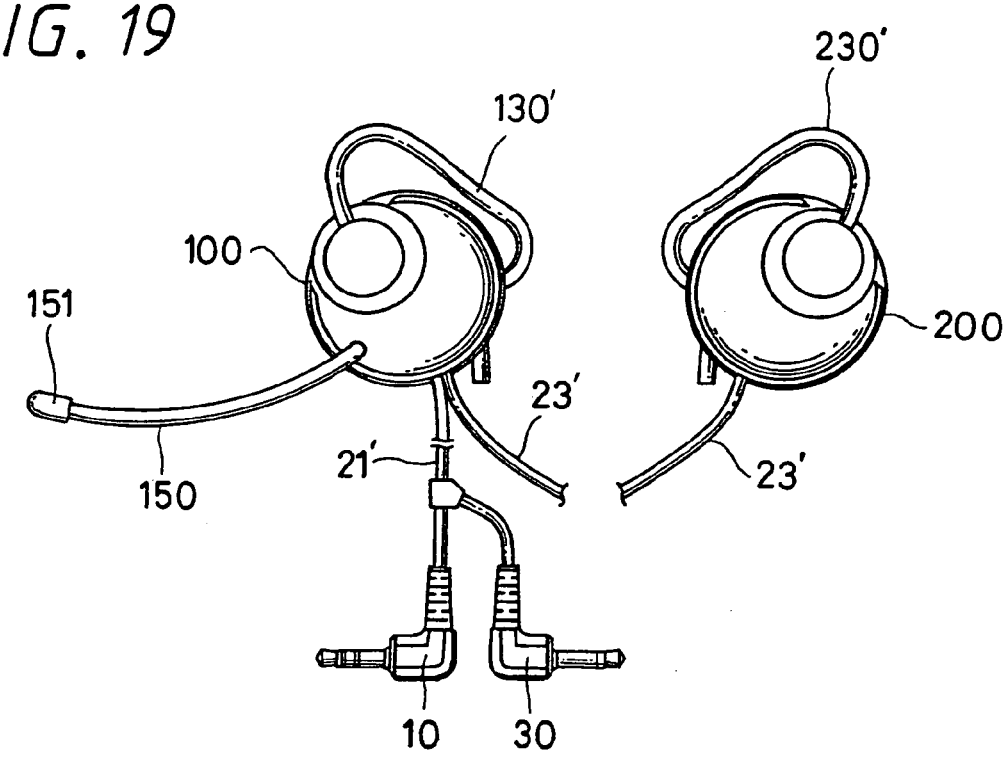
FIG. 19 is a plan view showing an example of a case in which a microphone is attached to a pair of headphones according to an embodiment of the present invention.

Specifically, as shown in FIG. 19, for example, a microphone 151 is attached to the edge of a rod-shaped microphone-connecting member 150 on the left side unit 100 which is hung on the auricle by an arm 130'. A microphone is not provided on the right side unit 200 which is hung on the auricle by an arm 230'. Then, the left side unit 100 and the right side unit 200 are connected by a cord 23', wires for an audio-signal and a microphone signal are passed through a cord 21' that extends from the left side unit 100, and a microphone plug 30 as well as the plug 10 for inputting an audio signal is connected. It is noted that in the example of FIG. 19, the arms 130' and 230' are narrower in width than the arms 130 and 230 shown in FIG. 4. Further, as shown in FIG. 20, a microphone 40 may be attached, for example, to a halfway position of a cord 23" connecting the left side unit 100 and the plug 10. Note that in this example of FIG. 20 a microphone plug 51 is attached to a microphone plug fixing member 50 provided at a halfway position of the cord 23". Further, a microphone plug and a plug for inputting an audio signal may be composed of one plug.

Also, although in the above-mentioned embodiment the invention is applied to the headphone in which a driver unit is driven by an audio signal that has been inputted from outside via a cord, a headphone that accommodates therein an audio signal source using such as a semiconductor memory or the like may be constructed, or a circuit which receives a radio signal may be accommodated within a headphone in order for an audio signal to be transmitted as a radio signal, for example.

INDUSTRIAL APPLICABILITY

According to the present invention, since a flange portion which is connected to the flange portion on the housing side is provided on the arm side which is joined to the housing, a flange portion is also formed at what is called an undercut area when the housing is formed with resin, thereby the flange portion for attaching an ear pad being formed in approximately a circular shape to hold an ear pad favorably. Consequently, when worn by a listener, discomfort caused by partly lacking the flange portion is negligible, and also it is possible to prevent such damage as the breaking of the ear pad efficiently.

In this case, the housing has a peaked portion which extends from a storing portion of the driver unit to the outside, and when the housing and the arm have been joined, the second flange portion is placed approximately inside the peaked portion, so that the portion where the housing and the arm are joined is concealed beneath the peaked portion, and the state in which the housing and the arm are joined becomes thus inconspicuous.

Further, convex portions and concave portions which are engaged with each other on joining are provided on both ends of the first and second flange portions, so that when the housing and the arm are joined, the two flange portions are engaged with each other with the convex portion and the concave portion then become combined into a single unit, thereby forming a favorable shape of the flange portion for attaching the ear pad.

Further, since a hole or a groove into which an end of the arm is inserted is provided on the inner surface side of the housing where the driver unit is attached, the arm can be easily and reliably attached to the housing utilizing the hole or the groove.

Further, when a hole or a groove into which an end of the arm is inserted is provided in the housing in this manner, a convex portion and a concave portion which are engaged with each other on joining are provided on an end of the arm inserted into the hole or the groove and on the inner surface of the housing, so that the state in which the housing and the arm ate joined is further favorably maintained.

Further, since a driver unit fixing projection or a driver unit fixing groove is provided on the inside surface of the housing to which the driver unit is attached, the driver unit is easily fixed to the housing.

Further, when a driver unit fixing projection or a driver unit fixing groove is provided on the housing side in this manner, a driver unit fixing projection or a driver unit fixing groove is also provided on the second flange side of the arm, so that the driver unit can be held by the arm side combined with the housing as well, thereby further the driver unit being held favorably.

Further, since a cutaway portion for passing through a cord, one end of which is connected to the driver unit, is provided on the first flange portion of the housing, a cord which supplies an audio signal or the like to the driver unit passes through the cutaway portion easily.

Furthermore, when the above cutaway portion for passing a cord is thus provided, the cutaway portion is made to bend, so that by the bend it is possible to lock a cord within the housing easily without providing any additional mechanism to lock the cord.

Furthermore, since a joint mechanism portion to attach a cap of predetermined shape is provided on the outside of the housing and the boundary between the ear pad provided on the first and second flange portions and the housing is concealed by the cap attached to the joint mechanism portion, favorably shaped headphones can be provided with a simple construction in which a smaller number of components are used.

The invention claimed is:

1. A headphone operable to be worn on an auricle of a listener, said headphone comprising:

a driver unit operable to be driven by an audio signal, a housing which therein accommodates said driver unit and includes a first flange portion on a periphery thereof to which an ear pad is attached on an outside, and an arm joined to said housing and shaped to be hung on an upper rear part of the auricle, and including a second flange portion connected to said first flange portion when joined to said housing;

wherein said first flange portion of said housing and said second flange portion of said arm form an approximately circular flange when connected to each other.

2. The headphone according to claim 1, further comprising convex portions engaged upon connection to each end of said first and second flange portions.

3. The headphone according to claim 1, further comprising concave portions engaged upon connection to each end of said first and second flange portions.

4. The headphone according to claim 1, wherein said housing further comprises a hole on an inside surface of said housing into which an end of said arm is inserted.

5. The headphone according to claim 4, further comprising convex portions engaged upon connection to an end of said arm inserted into said hole and to the inside surface of said housing.

6. The headphone according to claim 4, further comprising concave portions engaged upon connection to an end of said arm inserted into said hole and to the inside surface of said housing.

7. The headphone according to claim 1, wherein said housing further comprises a groove on an inside surface of said housing into which an end of said arm is inserted.

8. The headphone according to claim 7, further comprising convex portions engaged upon connection to an end of said arm inserted into said groove and to the inside surface of said housing.

9. The headphone according to claim 7, further comprising concave portions engaged upon connection to an end of said arm inserted into said groove and to the inside surface of said housing.

10. The headphone according to claim 1, wherein said housing further comprises a projection on an inside surface of said housing to which accommodate said driver unit.

11. The headphone according to claim 10, wherein said projection comprises a first projection and said second flange portion of said arm further comprises a second projection for accommodating said driver unit.

12. The headphone according to claim 10, wherein said second flange portion of said arm further comprises a groove for accommodating said driver unit.

13. The headphone according to claim 1, wherein said housing further comprises a groove on an inside surface of said housing to which accommodate said driver unit.

14. The headphone according to claim 13, wherein said second flange portion of said arm further comprises a projection for accommodating said driver unit.

15. The headphone according to claim 13, wherein said groove comprises a first groove and said second flange portion of said arm further comprises a second groove for accommodating said driver unit.

16. The headphone according to claim 1, wherein said first flange portion of said housing further comprises a cutaway portion for passing a cord through, one end of said cord being connected to said driver unit.

17. The headphone according to claim 16, wherein said cutaway portion is bent into a predetermined shape.

18. The headphone according to claim 1, further comprising a joint mechanism portion on an outside of said housing to which a cap of predetermined shape is attached, and wherein a boundary between said ear pad attached to said first and second flange portions and said housing is concealed by said cap attached to said joint mechanism portion.

19. The headphone according to claim 1, wherein said housing further includes a peaked portion on the outside that protrudes from a portion accommodating said driver unit, and when said housing and said arm are joined, said second flange portion is placed inside said peaked portion.

* * * * *